US005937654A

United States Patent [19]

Tunkel et al.

[11] Patent Number: 5,937,654

[45] Date of Patent: Aug. 17, 1999

[54] VORTEX TUBE FOR SNOW MAKING

[75] Inventors: Lev Tunkel, Edison, N.J.; Boris Krasovitski, Nesher, Israel; Robert L. Foster, Manasquan, N.J.

[73] Assignee: Universal Vortex, Inc., Robbinsville, N.J.

[21] Appl. No.: 08/886,098

[22] Filed: Jun. 30, 1997

[51] Int. Cl.[6] ..... F25B 9/04

[52] U.S. Cl. ..... 62/5

[58] Field of Search ..... 62/5, 74, 347

[56] References Cited

U.S. PATENT DOCUMENTS 1,952,281 3/1934 Ranque ..... 62/5

3,969,908 7/1976 Lawless et al. ..... 62/5

5,331,817 7/1994 Anthony ..... 62/5

5,394,703 3/1995 Anthony ..... 62/5

*Primary Examiner*—William E. Tapolcal

*Attorney, Agent, or Firm*—McAulay Nissen Goldberg Kiel & Hand, LLP

[57] ABSTRACT

A snow making machine uses a vortex tube to mix the water with the chilled air to make snow. The vortex tube is equipped with fins on is external surface in order to create an extra chilled air jet to be mixed outside of the vortex tube with a water jet.

10 Claims, 2 Drawing Sheets

VORTEX TUBE FOR SNOW MAKING

BACKGROUND OF THE INVENTION

1. Field of the Invention

This invention is concerned with vortex tubes. More particularly, the present invention relates to a method of snowmaking utilizing a vortex tube which design provides a higher snowmaking efficiency by improving process parameters and by elimination of any freeze up during operation.

2. Description of the Prior Art

It is known to make snow by the air and water jets interaction. The system harnessing this method comprises an air nozzle connected with a source of compressed air and a water nozzle connected with the water pump. Both air and water nozzles are mounted on the tower in a manner when the nozzle's axes, being set up in the plane, compose a sharp angle.

A high velocity air jet discharged from the nozzles hits a high velocity water stream and as a result of the impact frozen particles (nuclears) create. Falling down in a cold ambient air, these small particles grow up and turn into snow.

The snowmaking process is very sensitive to the ambient air conditions. Under relatively high temperature and/or air humidity the falling particles became wet or even melt and turn into rain. Under relatively low ambient air temperature an air nozzle may get plugged with ice—as a result of the water droplets freezing on the chilled nozzle surface.

A vortex tube as a means to create a chilled air jet allows to decrease a snowmaking process vulnerability e.g. to operate efficiently under higher ambient air temperatures and/or higher humidity as well as, by utilizing a vortex tube's internal source of heating, eliminate any freeze up during the system operations.

It is known to use a vortex tube for energy separation when the vortex tube is fed with a compressible fluid under a positive (i.e., above atmospheric) pressure. In a vortex tube, the initial flow is transformed into two separate currents of a different energy (a cold and a hot fraction) leaving the vortex tube under pressure which is less than the inlet pressure, but at a pressure still above atmospheric.

A vortex tube comprises a slender tube with a diaphragm closing one end of the tube provided with a hole in the center of the diaphragm for discharge of the cold fraction, one or more tangential inlet nozzles piercing the tube just inside of the diaphragm, and a controlled hot fraction discharge opening such as a throttle valve or any other restrictive body at the far end or the other end of the slender tube.

For the sake of simplicity in the use of terms, the term "throttle" will be used hereinafter in a broad sense to define a controlled hot fraction discharge opening, a restrictive body or a throttle valve.

Even today, the full theory of the vortex tube, explaining all its features, has not yet been created or established. However, the principal mechanism of the vortex phenomenon can be described in the following manner. An expanding gas after passing the tangential nozzle develops into a high speed rotating body (a vortex). The gas in the vortex is cooled because part of its total energy converts into kinetic energy. An angular velocity in the vortex is low at the periphery zone and very high toward the center zone. Friction between the central and periphery zones reduces all of the gas to the same angular velocity as is in a solid body. This causes the inner layer to slow down and the outer layers to speed up. As a result, the inner layers lose part of their kinetic energy and their total temperature decreases. The periphery layers receive the energy from the internal layers. This energy converts to heat through friction in the "hot" end of the tube.

This mechanism can be applied to any vortex tube's mode of operation, e.g. with a separate cold and hot fraction discharge or with an inlet flow discharge through diaphragm (the throttle is closed) or through a throttle valve (diaphragm opening is closed). However, since for the last two vortex tube's modes, the internal (cold) and the external (hot) vortex layers mix up at the same discharge orifice, an outlet flow temperature in the insulated (adiabatic) vortex tube is equal to the inlet gas temperature.

SUMMARY OF THE INVENTION

To this end, the present invention consists of the provision of a snowmaking system design capable to operate efficiently in a broad range of the ambient air temperature/humidity. This is achieved by equipping a vortex tube with fins on its external surface in order to create an extra chilled air jet to be mixed outside of the vortex tube's with a water jet, as well as by applying a vortex tube hot duty to warm up all vortex tube's surfaces and in particular, a diaphragm in order to prevent water freeze up.

DETAILED DESCRIPTION OF THE PREFERRED EMBODIMENTS

Figure 1:
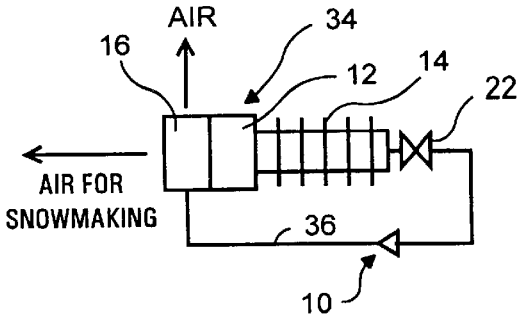
FIG. 1 is a schematic design and flow diagram of one embodiment according to the invention.

With reference to the accompanying drawings, and in particular, to the schematic design and flow diagram of FIG. 1 which illustrates one embodiment of the invention, a snowmaking vortex tube assembly 10 according to the invention includes a vortex tube 12, having its slender tube equipped with fins 14 and a throttle 22 on the far end of the slender tube and a heat exchanger 16 attached to the outward side of the vortex tube's diaphragm.

An air flow in the direction of arrow 34 enters assembly 10 through the vortex tube's nozzles and then undergoes an energy (temperature) separation, forming cold and hot fraction.

A cold fraction is discharged from the vortex tube 12 through diaphragm connected with the inlet of heat exchanger's inner tube, then goes through a tube and leaves or exits from the assembly through the heat exchanger's inner tube outlet. A hot fraction is discharged from the throttle 22 and is then directed through line 36 and its outlet opening and enters heat exchanger 16 through it's shell inlet opening, and goes toward the shell's outlet opening simultaneously flowing over the inside surfaces of the heat exchanger and then leaves or exits the heat exchanger through it's shell outlet opening.

The function of fins 14 is to provide an efficient heat transfer outside from the vortex tube's wall. This leads to reduction of a hot fraction actual temperature and accordingly to reduction of a heat flow directed, due to the gas conductivity, from vortex periphery to the vortex center (opposed to the flow of kinetic energy as was described above).

As a result of this operation, the vortex center layers become colder, as well as a cold fraction flow discharged from the vortex tube's diaphragm.

This supercooled flow during an interaction with a water jet can maintain favorable conditions for snow particles creation and growing up. Since a melting process, in general, takes more time than a freezing one, there is a good opportunity for the particles to survive even in the relatively high ambient air temperature/humidity and successfully descend on the frozen ground/snow bed.

The function of heat exchanger 16 is to maintain the vortex tube's diaphragm surface temperature above freezing, thus preventing for the water droplets/ice crystals carrying with flow discharged from a diaphragm to freeze up and plug the vortex tube.

In a vortex tube's chilled central layers, a condensation of a feed's saturated vapor quite often takes place. In general, a condensed liquid in the form of drops under influence of a swirling flow's high centrifugal forces are forced to the vortex periphery and then, being mixed up with a hot flow, leave the vortex tube through a controlled discharge opening.

However, if a vortex tube's mode of operation calls for a relatively large volume of a cold fraction, for example, in order to obtain a larger cooling duty or to increase it's impact energy, the flow which goes through the vortex tube's diaphragm hole includes not only a vortex tube's chilled and dried central layers but also some relatively less chilled peripheral layers which contain a liquid droplets.

This entrapped liquid which typically is water, could begin to freeze at the cold diaphragm surfaces causing the diaphragm hole to decrease and, accordingly, cause a severe deterioration of the vortex tube's performance.

In a case when the inlet gas flow already carries some liquid (this is, for instance, quite typical for the compressed air), a presence of the original water drops results in an even faster development of the above mentioned situation.

An internal vortex tube's energy (hot duty) applied according to present invention through a heat exchanger to diaphragm eliminates a diaphragm freezing.

It should be understood that the freezing water particles availability in the air discharged from the vortex tube is a factor beneficial for the snowmaking. Those particles are an addition to the particles created in the course of the air and water jets interaction.

At this point, the heat exchanger efficiency shall not exceed the point when it may cause the crystals melting on the warmed inner surfaces.

Another function of heat exchanger 16 is to maintain its outer surface temperature above freezing in order to prevent a water jet's frozen droplets plug up an air jet discharge opening.

Figure 2:
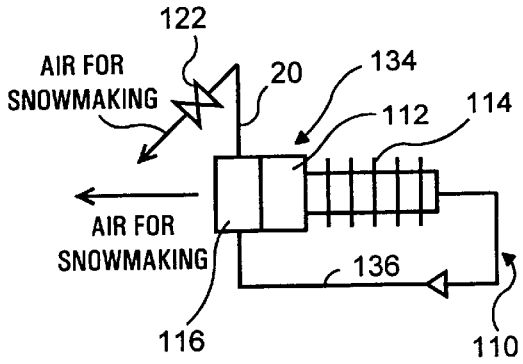
FIG. 2 is a schematic design and flow diagram of another embodiment of the invention.

Another embodiment of the present invention allowing to utilize for snowmaking both 'cold' and 'hot' vortex tube's outlet flows is shown in FIG. 2. In this embodiment, parts similar to the parts in FIG. 1 have been raised by 100.

As shown on the schematic design and flow diagram of FIG. 2, a snowmaking vortex tube assembly 110 according to the invention includes a vortex tube 112, having it's slender tube equipped with fins 114 and a heat exchanger 116 attached to the outward side of the vortex tube's diaphragm.

The main feature of the described embodiment of FIG. 2 consists in the placement of the vortex tube's throttle 122 on the pipe 20 connected with the heat exchanger's shell outlet opening. Such throttle position provides for a hot flow to be discharged with a high velocity (high impact ability) at the desirable point of its interaction with a water jet.

Necessary to mention that a hot air after transferring its energy to the various vortex tube's surfaces as well a s to the cold shell/throttle connection pipe's wall, is no longer a high temperature air. At this point, being discharged into ambient air, it rapidly adopts an air temperature and can be used for snowmaking.

An air flow in the direction of arrow 134 enters assembly 110 through the vortex tube's nozzles and then undergoes an energy (temperature) separation, forming a cold and a hot fraction.

A cool fraction is discharged from the vortex tube 112 through diaphragm connected with the inlet of heat exchanger's inner tube, then goes through a tube and leaves or exists from the assembly through the heat exchanger's inner tube outlet. A hot fraction is directed through line 136 and its outlet opening into heat exchanger 116 through its shell's inlet opening, then goes toward the shell's outlet opening, simultaneously flowing over the inside surfaces of the heat exchanger and leaves or exist heat exchanger through its shell's outlet opening. Then a hot fraction goes through connection pipe 20 equipped with at least one supplementary surface. Connection pipe 20 brings air to the vortex tube's throttle 122 situated in the desired proximity to the cold fraction/water interaction point. Finally, a hot air is discharged from the throttle to be mixed with cold fraction air and water for snowmaking.

Figure 3:
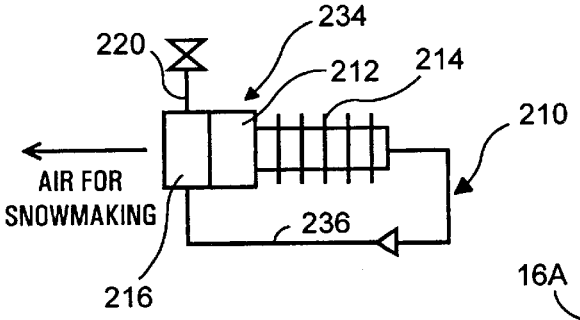
FIG. 3 is a schematic design and flow diagram of another embodiment of the invention.

Another embodiment of the present invention provided to create the highest chilled air flow impact as well as to utilize for snowmaking all particles crystallized in the vortex tube is shown in FIG. 3. In this embodiment, parts similar to the parts in FIG. 1 have been raised by 200. As shown on the schematic design and flow diagram of FIG. 3, a snowmaking vortex tube assembly 210 according the invention includes a vortex tube 212, having its slender tube equipped with fins 214, and a heat exchanger 216 attached to the outward side of the vortex tube's diaphragm 217.

The main feature of the described embodiment of FIG. 3 consists in maintaining a hot flow discharge throttle 220 connected with heat exchanger's shell outlet closed, thus causing a hot flow circulation providing for the hot flow to heat up the heat exchanger's surfaces on its way out of the slender tube and provides for a hot flow mix up with the cold fraction on its way back to the slender tube's center. An air flow in the direction of arrow 234 enters assembly 210 through the vortex tube's nozzles and then undergoes an energy (temperature) separation, forming a cold and a hot fraction. A hot fraction which in this vortex tube's mode of operation represents layers circulating alongside of the vortex periphery is directed through line 236 and its outlet opening into heat exchanger 216 through its shell's inlet opening, flowing over the inside surfaces of the heat exchanger and leaves or exits heat exchanger via central low pressure area of the heat exchanger shell's inlet opening and line 236 to be joined with a central chilled area of the vortex tube. A combined stream, possessing a vortex tube's full flow impact energy, is discharged from the vortex tube 212 through diaphragm 217 connected with the inlet of heat exchanger's inner tube then goes through a tube and leaves or exists from the assembly through the heat exchanger's inner tube outlet.

In some cases, in order to cover a desirable for snowmaking air flow rate, it is more expedient to use two vortex tubes instead of one. Under such circumstances another embodiment of the present invention may be successfully used.

Figure 4:
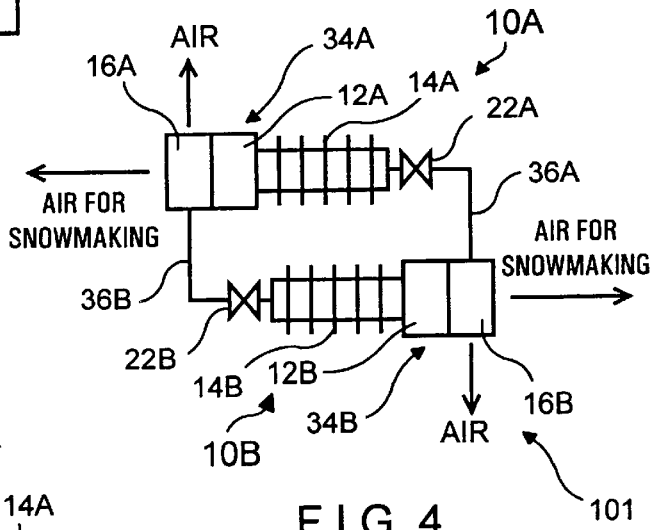
FIG. 4 is a schematic design and flow diagram of another embodiment of the invention.

As it is shown on the schematic design and flow diagram in FIG. 4, a snowmaking vortex tube arrangement 101 according to invention includes two vortex tube assemblies 10A and 10B.

Specifically, assembly 10A includes a vortex tube 12A, having it's slender tube equipped with fins 14A, a throttle 22A on the far end of the slender tube and a heat exchanger 16A attached to the outward side of the vortex tube's diaphragm 17A.

Assembly 10B includes a vortex tube 12B, having it's slender tube equipped with fins 14B, a throttle 22B on the far end of the slender tube and a heat exchanger 16B attached to the outward side of the vortex tube's diaphragm 17B.

An air flow in the direction of arrow 34A enters assembly 10A through the vortex tube's nozzles and then undergoes an energy (temperature) separation, forming cold and hot fraction. An air flow in the direction of arrow 34B enters assembly 10B through the vortex tube's nozzles and then undergoes an energy (temperature) separation, forming cold and hot fraction.

A cold fraction is discharged from the vortex tube 12A through diaphragm 17A connected with the inlet of heat exchanger's 16A inner tube, then goes through the tube and leaves or exits the assembly 10A (the arrangement) through the heat exchanger's inner tube outlet. A hot fraction discharged from the throttle 22A is then directed through line 36A. And, in a similar manner, a cold fraction is discharged from the vortex tube 12B through diaphragm 17B connected with the inlet of heat exchanger's 16B inner tube, then goes through the tube and leaves or exits from the assembly (from the arrangement) through the heat exchanger's inner tube outlet. A hot fraction discharged from the throttle 22B is then directed through line 36B.

After passing line 36A and its outlet opening, a hot fraction then enters heat exchanger 16B through it's shell inlet opening, and goes toward the shell's outlet opening simultaneously flowing over the inside surfaces of the heat exchanger and then leaves or exits the assembly 10B (the arrangement) through the heat exchanger's shell outlet.

Simultaneously, after passing line 36B and it's outlet opening, a hot fraction enters heat exchanger 16A through it's shell inlet opening, and goes toward the shell's outlet opening simultaneously flowing over the inside surfaces of the heat exchanger and then leaves or exits the assembly 10A (the arrangement) through the heat exchanger's shell outlet.

In a case when there are two vortex tubes in operation, each with a requirement to utilize for snowmaking both 'cold' and 'hot' vortex tube's outlet flows, another embodiment of the present invention (see FIG. 5) may be successfully used.

Figure 5:
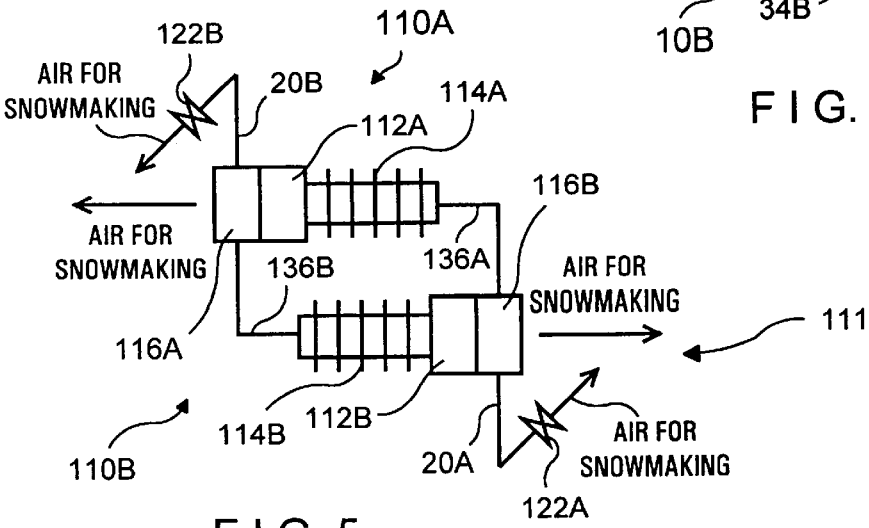
FIG. 5 is a schematic design and flow diagram of another embodiment of the invention.

As it is shown on the schematic design and flow diagram of FIG. 5, a snowmaking vortex tube arrangement 111 according to invention includes two vortex assemblies 110A and 110B.

Specifically, assembly 110A includes a vortex tube 112A, having it's slender tube equipped with fins 114A and a heat exchanger 116A attached to the outward side of the vortex tube's diaphragm.

In this embodiment a vortex tube's throttle 122A is connected with a heat exchanger's shell outlet opening through connection pipe 20A which is equipped with a least one supplementary surface.

Assembly 110B includes a vortex tube 112B, having it's slender tube equipped with fins 114B and a heat exchanger 116B attached to the outward side of the vortex tube's diaphragm 117B.

In this embodiment a vortex tube's throttle 122B is connected with a heat exchanger's shell outlet opening through connection pipe 20B which is equipped with at least one supplementary surface.

The main feature of the described embodiment in FIG. 5 consists in a connection of the far end of the vortex tube's 112A slender tube through line 136A and its outlet with heat exchanger's 116B shell inlet opening and further through heat exchanger's 116B shell outlet and connection pipe 20A with vortex tube's 112A throttle 122A situated in the desirable proximity to the vortex tube's 112B cold fraction/water jet interaction point and, accordingly, connection of the far end of the vortex tube's 112B slender tube through line 136B and its outlet with heat exchanger's 116A shell inlet opening and further through heat exchanger's 116A shell outlet and connection pipe 20B with vortex tube's 112B throttle 122B situated in the desirable proximity to the vortex tube's 112A cold fraction/water jet interaction point.

Figure 6:
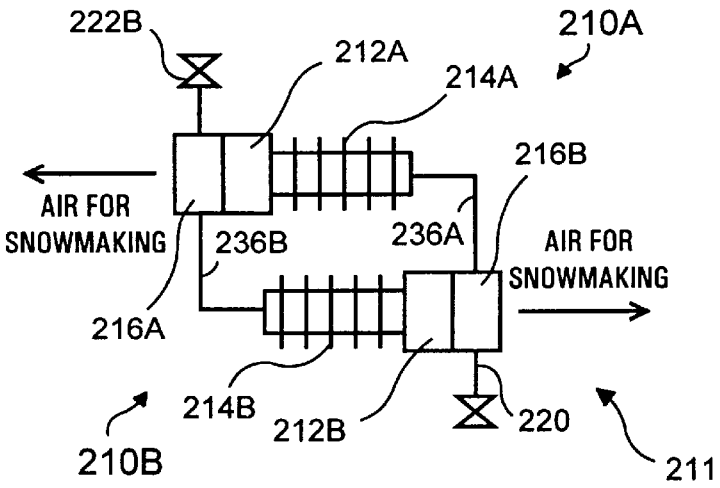
FIG. 6 is a schematic design and flow diagram of another embodiment of the invention.

Another embodiment of the present invention reflecting the case when both vortex tubes are to provide the highest chilled air flow impact, as well as to utilize for snowmaking all particles crystallized in the vortex tube is shown in FIG. 6.

As it is shown on the schematic design and flow diagram in FIG. 6, a snowmaking vortex tube arrangement 211 according to invention includes two vortex tube assemblies 210A and 210B.

Specifically, assembly 210A includes a vortex tube 212A, having its slender tube equipped with fins 214A and a heat exchanger 216A attached to the outward side of the vortex tube's diaphragm 217A.

Assembly 210B includes a vortex tube 212B, having its slender tube equipped with fins 214B and a heat exchanger 216B attached to the outward side of the vortex tube's diaphragm 217B.

A heat exchanger's 216A,shell inlet opening is connected through line 236B with the far end of the vortex tube 212B, while a heat exchanger's 216A shell outlet opening is connected with closed vortex tube's 212B throttle valve 220B.

Simultaneously, a heat exchanger's 216B shell inlet opening is connected through line 236A with the far end of the vortex tube 212A, while a heat exchanger's 216B shell outlet opening is connected with closed vortex tube's 212A throttle valve 220A.

Figure 7:
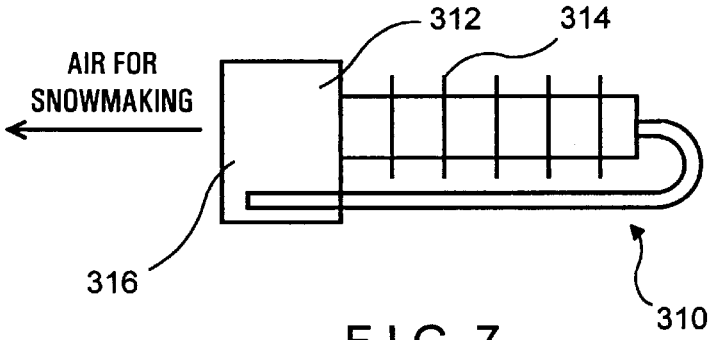
FIG. 7 is a schematic design and flow diagram of another embodiment of the invention.

Another embodiment of the present invention securing a non-freeze operation without the use of a conventionally designed heat exchanger for a snowmaking vortex tube with a highest chilled air flow impact and with utilization for snowmaking of all particles crystallized in the vortex tube is shown in FIG. 7. In this embodiment, parts similar to the parts in FIG. 1 have been raised by 300. As shown on the schematic design and flow diagram of FIG. 7, a snow making vortex tube assembly 310 according to the invention includes a vortex tube 312, having its slender tube equipped with fins 314 and a heat transfer body 316 coinciding with the vortex tube's inlet cross section.

The main feature of the described embodiment of FIG. 7 consists in connection of a slender tube's far end with a heat transfer body 316 in a manner that the slender tube's far end opening is completely dumped into the heat transfer body 316.

Thus provides for a vortex heated layers circulating alongside of the slender tube's periphery prior to joining a chilled vortex central layers and prior to the combined flow discharge through a diaphragm, bring its energy to the vortex tube's inlet cross section and, accordingly, due to the heat transfer body's conductivity, warm up a vortex tube's diaphragm to prevent its inside and outside freeze up.

In a case when two snowmaking vortex tubes are in operation, each without a conventionally designed heat exchanger, another embodiment to the present invention may be successfully used.

Figure 8:
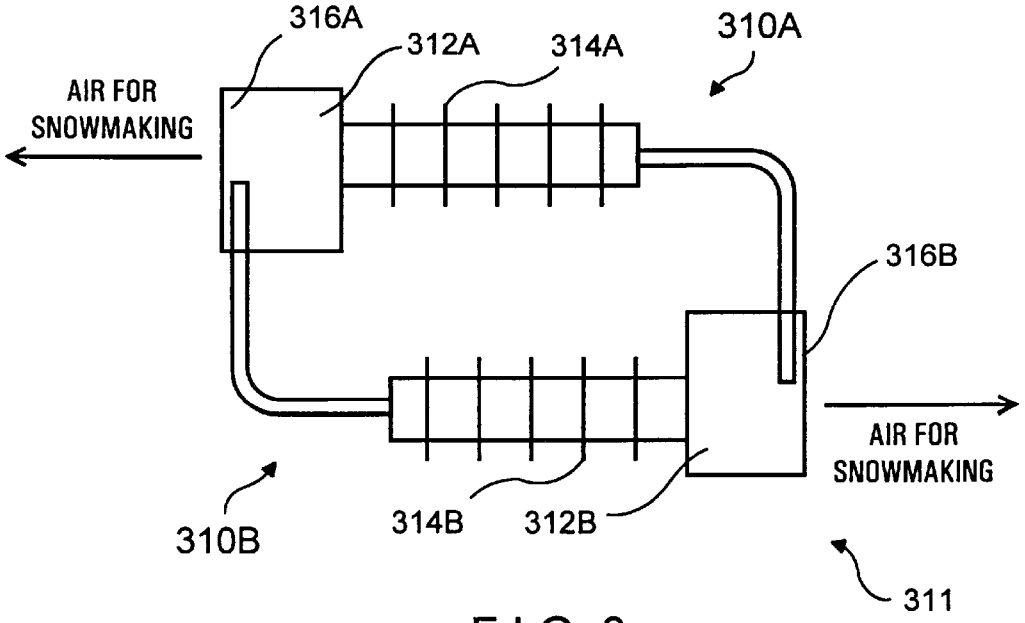
FIG. 8 is a schematic design and flow diagram of another embodiment of the invention.

As it is shown on the schematic design and flow diagram 317 in FIG. 8, a snowmaking vortex tube arrangement 311 according to the invention includes two vortex tube assemblies 310A and 310B.

Specifically, assembly 310A includes a vortex tube 312A, having its slender tube equipped with fins 314A,. and a heat transfer body 316A coinciding with the vortex tube's inlet cross section.

Assembly 310B includes a vortex tube 312B, having its slender tube equipped with fins 314B and a heat transfer body 316B coinciding the vortex tube's inlet cross section.

The far end of the vortex tube's 312A slender tube is connected with a heat transfer body 314B in a manner that the slender tube's far end opening is completely dumped into the heat transfer body.

The far end of the vortex tube's 312B slender tube is connected with a heat transfer body 314A in a manner that the slender tube's far end opening is completely dumped into the heat transfer body.

While there has been shown and described what is considered to be the preferred embodiment of the invention, various changes and modifications may be made therein without departing from the scope of the invention.

what is claimed is:

1. A design of a vortex tube for snowmaking in a process of interaction between water jet and air flow discharged from the vortex tube, the snowmaking vortex tube capable to operate efficiently in a broad range of ambient air temperatures/humidity and eliminate freeze-up problems includes the vortex tube having its slender tube equipped with fins and a heat exchanger attached to an outward side of a vortex tube's diaphragm, the design comprising ways of connecting the snowmaking vortex tube and discharging the vortex tube's outlet flows as follows:

connecting the vortex tube's diaphragm with an inlet of a heat exchanger's inner tube;

connecting a vortex tube throttle on a far end of the slender tube with a heat exchanger's shell inlet opening;

directing a cold fraction through the heat exchanger's inner tube and then discharging it through the heat exchanger's inner tube outlet opening; and directing a hot fraction to the heat exchanger's shell inlet opening, then through the heat exchanger's shell, for discharge through a heat exchanger's shell outlet opening.

2. The design of claim 1, including a connection pipe equipped with at least one supplemental surface.

3. A design of a vortex tube arrangement for snowmaking in the process of water jet and air flow discharged from the vortex tube interaction, the snowmaking vortex tube arrangement capable to operate efficiently in a broad range of the ambient air temperature/humidity and eliminate freeze up problems includes first and second vortex tubes each having its slender tube equipped with fins and a heat exchanger with a first of the heat exchangers being attached to the outward side of a diaphragm of the second vortex tube and the second heat exchanger being attached to the outward side of the first vortex tube, the design comprising ways of connecting the snowmaking vortex tube arrangement and discharging the first and second vortex tubes outlet flows as follows:

connecting the diaphragm of the first vortex tube with an inlet of an inner tube of the first heat exchanger;

connecting the diaphragm of the second vortex tube with an inlet of the inner tube of the second heat exchanger;

connecting a far end of the first vortex tube's slender tube with the second heat exchanger's shell inlet opening;

connecting a far end of the second vortex tube's slender tube with the first heat exchanger's shell inlet opening;

connecting a throttle of the first vortex tube through a connection pipe with the second heat exchanger's shell outlet opening;

connecting a throttle of the second vortex tube through a connection pipe with the first heat exchanger's shell outlet opening;

placing the throttle of the first vortex tube in proximity from the water jet/second vortex tube's cold fraction flow intersection;

placing the throttle of the second vortex tube in a desirable proximity from the water jet/first vortex tube's cold fraction flow intersection;

directing a cold fraction of the first vortex tube through an inner tube of the first heat exchanger and then discharging a cold fraction through a first heat exchanger's inner tube outlet opening;

directing a cold fraction of the second vortex tube through an inner tube of the second heat exchanger and then discharging a cold fraction through a second heat exchanger's inner tube outlet opening;

directing a hot fraction of the first vortex tube to the inlet opening of the second heat exchanger's shell then through a shell of the second heat exchanger and further through a connection pipe to be discharged through the first vortex tube's throttle; and directing a hot fraction of the second vortex tube to the inlet opening of the first heat exchanger's shell, then through a shell of the first heat exchanger and further through a connection pipe to be discharged through the second vortex tube throttle.

4. The design of claim 3, including connection pipes equipped with at least one supplemental surface each.

5. A design of the vortex tube for snowmaking in the process of water jet and air flow discharged from the vortex tube interaction, the snowmaking vortex tube capable to operate efficiently in a broad range of ambient air temperatures/humidity and eliminate freeze up problems includes a vortex tube, having its slender tube equipped with fins and a heat transfer body coinciding with the vortex tube's inlet cross section, the design comprising ways of connecting the snowmaking vortex tube and discharging the vortex tube's outlet flows as follows:

connecting a far end of the vortex tube's slender tube with a heat transfer body in a manner that the slender tube's far end opening is completely dumped into the heat transfer body, thus causing a hot flow circulation, thus providing for a hot flow prior to joining a chilled vortex central layers warm up the heat transfer body; and discharging a combined air stream through a vortex tube's diaphragm.

6. A design of the vortex tube arrangement for snow making in the process of water jet and air flow discharged from the vortex tube interaction, the snowmaking vortex tube arrangement being capable to operate efficiently in a broad range of the ambient air temperatures/humidity and eliminate freeze up problems includes first and second vortex tubes, each having slender tube equipped with fins, a first heat transfer body coinciding with the first vortex tube's inlet cross section and a second heat transfer body coinciding with the second vortex tube's inlet cross section, the design comprises ways of connecting the snow making vortex tube arrangement and discharging the vortex tubes outlet flows as follows:

connecting the far end of the first vortex tube's slender tube with a heat transfer body of the second vortex tube in a manner that the slender tube's far end opening is completely dumped into the heat transfer body, thus causing a first vortex tube's hot flow circulation, thus providing for a hot flow, prior to joining the chilled vortex central layers, warm up the heat transfer body of the second vortex tube; and connecting the far end of the second vortex tube's slender tube with a heat transfer body of the first vortex tube in a manner that the slender tube's far end opening is completely dumped into the heat transfer body, thus causing a second vortex tube's hot flow circulation, thus providing for a hot flow, prior to joining the chilled vortex central layers, warm up the heat transfer body of the first vortex tube.

7. The design of claim 6, including the steps of discharging the combined air flow of the first vortex tube through the first vortex tube's diaphragm; and, discharging the combined air flow of the second vortex tube through the second vortex tube's diaphragm.

8. A design of a vortex tube arrangement for snow making in a process of water jet and air flow discharged from a vortex tube interaction, the snow making vortex tube arrangement being capable to operate efficiently in a broad range of ambient air temperatures/humidity and eliminate freeze up problems and includes two vortex tubes, each having its slender tube equipped with fins, a first heat transfer body coinciding with outward of a first of the two vortex tube's inlet cross section, said first heat transfer body having an inner cavity which surrounds the first vortex tube's diaphragm and a second heat transfer body coinciding with outward of a second vortex tube's inlet cross section, said second heat transfer body having an inner cavity which surrounds the outward side of the second vortex tube's diaphragm, the design comprising ways of connecting the snow making vortex tube arrangement and discharging the vortex tubes outlet flows as follows:

connecting the far end of the first vortex tube's slender tube with the heat transfer body of the second vortex tube in a manner that the connection line's outlet opening is completely dumped into the heat transfer body's cavity, thus causing a first vortex tube's hot flow circulation, thus providing for a hot flow, prior to joining the chilled vortex central layers, warm up the air discharge area of the second vortex tube;

connecting the far end of the second vortex tube's slender tube with the heat transfer body of the first vortex tube in a manner that the connection line's outlet opening is completely dumped into the heat transfer body's cavity, thus causing a second vortex tube's hot flow circulation, thus providing for a hot flow, prior to joining the chilled vortex central layers, warm up the air discharge area of the first vortex tube;

discharging the combined air flow of the first vortex tube through the first vortex tube's diaphragm; and discharging the combined air flow of the second vortex tube through the second vortex tube's diaphragm.

9. A design of a vortex tube arrangement for snow making in a process of water jet and air flow discharged from the vortex tube interaction, the snow making vortex tube arrangement being capable to operate efficiently in a broad range of ambient air temperatures/humidity and eliminate freeze up problems including two vortex tubes, each having its slender tube equipped with fins, a first heat transfer body coinciding with outward of the first vortex tube's inlet cross section, said first heat transfer body having an inner cavity which surrounds the first vortex tube's diaphragm and a second heat transfer body coinciding with outward of the second vortex tube's inlet cross section, said second heat transfer body having an inner cavity which surrounds the outward side of the second vortex tube's diaphragm, the design providing a self heating for each vortex tube comprising ways of connecting the snow making vortex tube arrangement and discharging the vortex tubes outlet flows as follows:

connecting the far end of the first vortex tube's slender tube with the heat transfer body of the first vortex tube in a manner that the connection line's outlet opening is completely dumped into the heat transfer body's cavity, thus causing a first vortex tube's hot flow circulation, thus providing for a hot flow, prior to joining the chilled vortex central layers, warm up the air discharge area of the first vortex tube;

connecting the far end of the second vortex tube's slender tube with a heat transfer body of the second vortex tube in a manner that the connection line's outlet opening is completely dumped into the heat transfer body's cavity, thus causing a second vortex tube's hot flow circulation, thus providing for a hot flow, prior to joining the chilled vortex central layers, warm up the air discharge area of the second vortex tube;

discharging the combined air flow of the first vortex tube through the first vortex tube's diaphragm; and discharging the combined air flow of the second vortex tube through the second vortex tube's diaphragm.

10. The design of claim 9 including assembly of a single vortex tube.

* * * * *